United States Patent [19]

Rudolph et al.

[11] Patent Number: 5,050,499

[45] Date of Patent: Sep. 24, 1991

[54] ARRANGEMENT FOR CORRECTING REGISTRATION IN A MULTI-COLOR ROTARY SHEET PRINTING PRESS

[75] Inventors: Otfried Rudolph, Dresden; Gunter Peter, Radebeul; Christian Schneider, Weinböhla; Steffen Piesch, Gröbern, all of Fed. Rep. of Germany

[73] Assignee: Robert Bosch GmbH, Stuttgart, Fed. Rep. of Germany

[21] Appl. No.: 564,537

[22] Filed: Aug. 7, 1990

[30] Foreign Application Priority Data

Aug. 7, 1989 [DE] Fed. Rep. of Germany ..... 3315277

[51] Int. Cl.[5] ..... B41F 5/16

[52] U.S. Cl. ..... 101/183; 101/216

[58] Field of Search ..... 101/183, 152, 216; 33/614, 618, 621, 623; 38/102.91

[56] References Cited

U.S. PATENT DOCUMENTS

| | | | |
|---|---|---|---|
| 1,338,347 | 4/1920 | Wood | 101/216 |
| 2,577,099 | 12/1951 | Albrecht | 101/183 |
| 2,637,270 | 5/1953 | Bamford . | |
| 3,477,370 | 11/1969 | Fischer | 101/183 |
| 3,496,865 | 2/1970 | Fischer | 101/183 |
| 3,606,800 | 9/1971 | Treff et al. | 101/216 X |
| 3,783,780 | 1/1974 | Saueressig | 101/216 X |
| 3,877,370 | 4/1975 | Hantscho | 101/216 |
| 4,220,083 | 9/1980 | Fischer | 101/216 |
| 4,821,643 | 4/1989 | Wieland | 101/183 X |
| 4,901,641 | 2/1990 | Steiner et al. | 101/152 |

FOREIGN PATENT DOCUMENTS

| | | | |
|---|---|---|---|
| 2707035 | 8/1978 | Fed. Rep. of Germany | 101/183 |
| 5715 | 12/1979 | Fed. Rep. of Germany | 101/183 |

*Primary Examiner*—Edgar S. Burr
*Assistant Examiner*—E. P. Raciti
*Attorney, Agent, or Firm*—Michael J. Striker

[57] ABSTRACT

An arrangement for correcting registration during guiding of sheets in a multi-color rotary sheet printing press including a plurality of printing units, each having a printing cylinder, a transfer cylinder connected between printing cylinders of two adjacent printing units for transfer sheets between the printing units, and a plurality of gear drives for driving the printing and transfer cylinders, includes a plurality of adjusting devices arranged within gear drives. Each adjusting device has two conical sleeves fixedly mounted within a gear drive, two conical bushings cooperating with the two conical sleeves, and an adjusting spindle for supporting the two conical bushings for linear displacement toward and away from each other.

6 Claims, 1 Drawing Sheet

FIG. 1
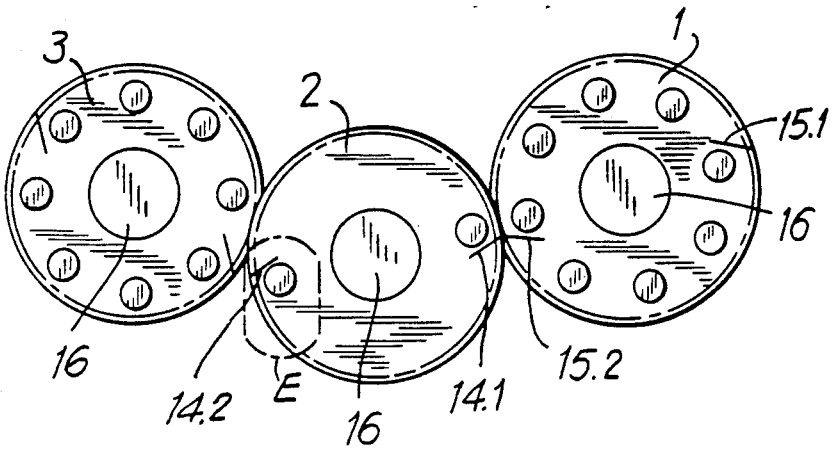
FIG. 2
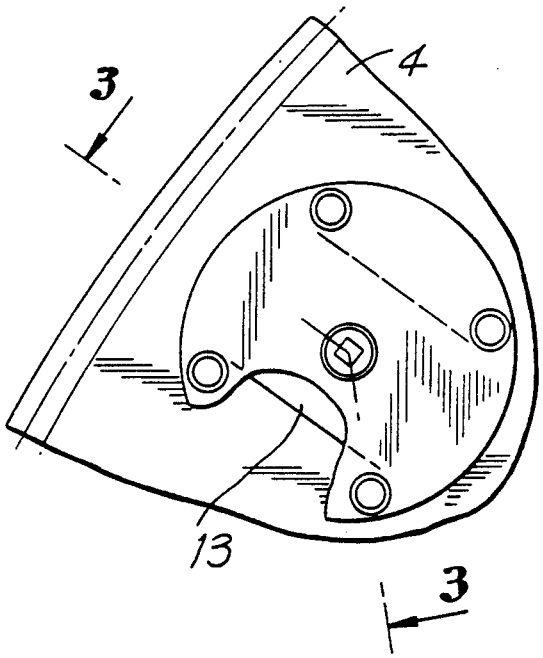
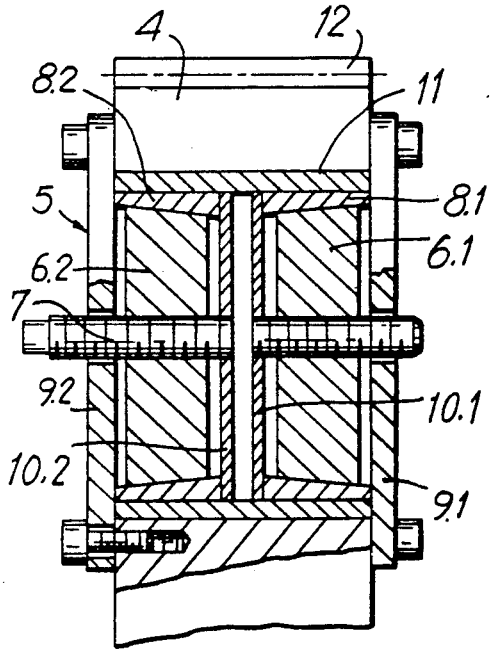
FIG. 3

ARRANGEMENT FOR CORRECTING REGISTRATION IN A MULTI-COLOR ROTARY SHEET PRINTING PRESS

BACKGROUND OF THE INVENTION

The invention relates to an arrangement for correcting registration in sheet guiding cylinders of a multicolor rotary sheet printing press in which sheets are transferred between individual printing units by transfer cylinders positively driven by gear drives and connected with respective printing cylinders of the individual printing units and also driven by gear drives.

The sheet guiding cylinders such as, i.e., transfer cylinders and printing cylinders are generally equipped with two diametrically opposite gripping elements. With these cylinders, the exactitude of operation of a rotary sheet printing press, in particular, maintaining of the registration when guiding the sheet and avoidance of doubling, is influenced by a quality of gear drives of sheet guiding cylinders. To provide for a precise exactitude of operation of a rotary sheet printing press, the sheet guiding cylinders and the drives should be manufactured with a high accuracy and that is connected with substantial expenses.

In multi-color printing presses, the position of a drive gear is changed by adjusting the gear of the drive relative to the middle point of a sheet guide cylinder and also relative the gripping element of the sheet guide cylinder, and a single deviation from a predetermined movement of one of the sheet guide cylinders requires adjusting of the drives of the entire press to minimize the error.

This method in multi-color printing presses results in high assembly costs and, besides, it may require dismounting of other structural units.

Another drawback of this method consists in that between the gear drive and a sheet guiding cylinder support, a wheel body need be mounted, and a correcting adjustment movement is provided for by a clearance between the wheel body and the sheet guiding cylinder. Providing such a body reduces the rigidity of mounting of the gear drive and of the entire gear train. Also, adjustment of the gear drive is necessary already during initial assembly of the press.

DE-OS 17 61 754 discloses providing in a gear drive, in the sheet transfer region, specially formed adjusting teeth to achieve an increased accuracy of sheet transfer. The drawback of this solution consists in that with time, because of teeth wear, the accuracy of transfer is reduced, and it is difficult to manufacture these teeth with a high accuracy.

SUMMARY OF THE INVENTION

The object of the invention is an arrangement for use in guiding sheets by sheet guiding cylinders of a multicolor rotary sheet printing press, which provides for correcting of registration and eliminating doubling in a simple manner.

Another object of the invention is to provide a correcting arrangement that permits to simplify the manufacturing of the gear drive and to eliminate influence of the accuracy of manufacture of the gear teeth on the accuracy of the press operation.

Still another object of the invention is a correcting arrangement which permits to increase connection of the gear drive with the sheet guiding cylinder and the rigidity of mounting of the gear drive.

This and other objects are achieved by a correcting arrangement that comprises a plurality of adjusting devices each including two conical sleeves fixedly mounted within a respective gear drive, two conical bushings engaging the two fixedly mounted conical sleeves, and an adjusting spindle for supporting the two conical bushings for linear movement toward and away from each other.

An adjusting device is provided in a region of a respective gripping element in each of the cylinders and, in printing cylinders, a plurality of the adjusting devices is provided over the circumference of the printing cylinders parallel to the printing area thereof.

The present invention both as to its construction so to its method of operation, together with additional objects and advantages thereof, will be best understood from the following detailed description of specific embodiments when read in connection with the accompanying drawing.

BRIEF DESCRIPTION OF THE DRAWINGS

FIG. 1 shows a schematic side view of a printing cylinder and a transfer cylinder;

FIG. 2 shows a front view of a portion E in FIG. 1 of an adjusting device according to the invention; and FIG. 3 shows a cross-sectional view of the adjusting device along line A—A in FIG. 2.

DETAILED DESCRIPTION OF THE PREFERRED EMBODIMENT

FIG. 1 shows a schematic view of a cylinder arrangement in a multi-color sheet rotary printing press. The cylinder arrangement includes printing cylinders 1 and 3 and a transfer cylinder 2 which represent sheet guiding cylinders. The transfer cylinder 2 is equipped with gripper elements 14.1 and 14.2, and printing cylinders 1 and 3 are equipped with gripper elements 15.1 and 15.2. As shown in FIG. 3, the gear drive 4 of a sheet guiding cylinder is associated with an adjusting device 5. The adjusting device 5 includes two opposite conical bushings 6.1 and 6.2 connected by means of an adjusting spindle 7. The adjustable conical bushings 6.1 and 6.2 cooperate respectively with fixedly mounted conical sleeves 8.1 and 8.2 the axial position of which is determined with washers 9.1 and 9.2 and cover washers 10.1 and 10.2. The conical bushings 6.1 and 6.2 as well as conical sleeves 8.1 and 8.2 taper in opposite directions, respectively.

By rotation of the adjusting spindle 7 which has an outer thread cooperating, respectively, with left and right threads of the conical bushings 6.1 an 6.2, the conical bushings 6.1 and 6.2 move toward or away from each other. Upon movement of the bushings 6.1 and 6.2 toward each other, they, as a result of their conicity, are stressed in the bore of the gear drive, and the bore 11 is deformed which deformation is transmitted to teeth 12. The bushings 6.1 and 6.2 are provided on sides thereof with flattenings 13 so that deformation is transmitted only in radial direction to the gear drive 4. Thereby the whole gear drive 4 can be mounted on an arm support 16 of the sheet guiding cylinder and, therefore, is mounted with a greater rigidity. Further, the shape and position deviation of different parts such as wheel body, do not bear on the total error of the sheet transfer cylinder.

It is advisable to mount the adjusting device before the gear of the gear drive 4 and with a prestress so that, in the assembled condition, by rotation of the adjusting spindle 7 in opposite directions, the deformation of the bore 11 can be increased or decreased. The invention enables to effect deformation of the gear rim and thereby a change in a gear geometry. The deformation of the gear rim provides for local and simultaneous correction of a plurality of individual errors in the position of the tooth flanks and thereby for proper transfer of the angular speed from one gear to another or from one cylinder to another. Thus, deformation of the gear flanks provides for accurate registration and permits to avoid doubling resulting from a difference in the angular speed.

The adjusting device 5 is provided in the region of each gripping element and, in printing cylinders, a plurality of adjusting devices are provided over the periphery of a printing cylinder parallel to printing area thereof as can be seen in FIG. 1.

While the invention has been illustrated and described as embodied in a registration correcting device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. An arrangement for correcting registration during guiding sheets in a multi-color, rotary sheet printing press including:

a plurality of printing units each having a printing cylinder, a transfer cylinder connected between printing cylinders of two adjacent printing units for transferring sheets between the printing units;

a plurality of gear drives for driving the printing and transfer cylinders;

said arrangement comprising a plurality of adjusting devices arranged within said gear drives, each of said adjusting devices including two conical sleeves fixedly mounted within said gear drives, two conical bushings matingly cooperating with said two conical sleeves, and an adjusting spindle with means for supporting said two conical bushings and linearly moving said conical bushings towards and away from each other.

2. An arrangement as set forth in claim 1, wherein the printing and transfer cylinders each have at least one gripping element, and the printing cylinder has a printing area, an adjusting device being provided in a region of each gripping element, and for the printing cylinders, a plurality of adjusting devices being provided over the circumference of a printing cylinder parallel to the printing area thereof.

3. An arrangement as set forth in claim 1, wherein said two adjustable conical bushings and said two fixed conical sleeves taper in respective opposite directions.

4. An arrangement as set forth in claim 1, wherein one of said adjustable conical bushings has a left thread, and the other of said adjustable conical bushings has a right thread, said adjusting spindle having respective left and right thread portions.

5. An arrangement as set forth in claim 1, wherein the gear drives have gear teeth, and the adjusting device is prestressed at the gear teeth.

6. An arrangement as set forth in claim 1, wherein each of the two adjustable conical bushings has a flat surface to provide for transmitting of the deformation only in a radial direction.

* * * * *